US009469448B2

(12) United States Patent
Jian et al.

(10) Patent No.: US 9,469,448 B2
(45) Date of Patent: Oct. 18, 2016

(54) CONTAINER AND LID LOCKING MECHANISM THEREOF

(71) Applicant: SHANGHAI HONGYAN RETURNABLE TRANSIT PACKAGINGS CO., LTD, Shanghai (CN)

(72) Inventors: Yuanli Jian, Shanghai (CN); Kai Gong, Shanghai (CN)

(73) Assignee: Shanghai Hongyan Returnable Transit Packagings Co., Ltd., Shanghai (CN)

( * ) Notice: Subject to any disclaimer, the term of this patent is extended or adjusted under 35 U.S.C. 154(b) by 0 days.

(21) Appl. No.: 14/422,115

(22) PCT Filed: Aug. 16, 2013

(86) PCT No.: PCT/CN2013/081661

§ 371 (c)(1),
(2) Date: Feb. 17, 2015

(87) PCT Pub. No.: WO2014/026646

PCT Pub. Date: Feb. 20, 2014

(65) Prior Publication Data

US 2015/0191281 A1 Jul. 9, 2015

(30) Foreign Application Priority Data

Aug. 16, 2012 (CN) ..... 2012 1 0295537

(51) Int. Cl.

| | |
|---|---|
| ***B65D 43/22*** | (2006.01) |
| ***B65D 77/06*** | (2006.01) |
| ***B65D 19/06*** | (2006.01) |

(52) U.S. Cl.

CPC ..... *B65D 43/22* (2013.01); *B65D 19/06* (2013.01); *B65D 77/061* (2013.01); *B65D 2251/00* (2013.01); *B65D 2519/00333* (2013.01); *B65D 2519/00711* (2013.01)

(58) Field of Classification Search

CPC .... B65D 43/22; B65D 19/06; B65D 77/061; B65D 2251/00; B65D 2519/00333; B65D 2519/00711

USPC ..... 220/318, 315, 324, 246, 326, 833; 16/63–65; 292/163, 137, 173, 175, 292/143, 145–147, 150, 300, 302, DIG. 11

See application file for complete search history.

(56) References Cited

U.S. PATENT DOCUMENTS 6,367,639 B1 * 4/2002 Mar ..... B65D 50/066 215/211
6,648,162 B1 * 11/2003 Wooderson ..... A47J 27/0813 220/203.27

(Continued)

FOREIGN PATENT DOCUMENTS

| | | |
|---|---|---|
| CN | 2464675 | 12/2001 |
| CN | 201385904 | 1/2010 |

(Continued)

OTHER PUBLICATIONS

International Search Report for application No. PCT/CN2013/081661, dated Nov. 21, 2013 (8 pages).

*Primary Examiner* — Robert J Hicks
*Assistant Examiner* — Kareen Thomas
(74) *Attorney, Agent, or Firm* — Hamre, Schumann, Mueller & Larson, P.C.

(57) ABSTRACT

A lid locking mechanism of a container is disclosed herein. the container includes a base, side plates and a lid. The locking mechanism is provided on an edge of the lid and an upper portion of the side plate; and the locking mechanism comprises a locking structure, a restoring structure and a guiding structure; wherein the locking structure is used to lock the lid to the side plates of the container, and the restoring structure and the guiding structure are used to assist the locking structure in locking the lid to the side plates. The locking mechanism of the present invention will not be damaged easily, and it is very convenient to open and close the lid provided with the locking mechanism.

6 Claims, 9 Drawing Sheets

(56) References Cited

U.S. PATENT DOCUMENTS

| | | | | |
|---|---|---|---|---|
| 7,108,135 | B2 * | 9/2006 | Park | H01L 21/67373 206/711 |
| 7,255,228 | B2 * | 8/2007 | Kim | A45C 11/00 206/305 |
| 2010/0200581 | A1 * | 8/2010 | Maltz | A01K 97/06 220/4.22 |

FOREIGN PATENT DOCUMENTS

| | | |
|---|---|---|
| CN | 102092541 | 6/2011 |
| CN | 102459021 | 5/2012 |
| CN | 102530437 | 7/2012 |
| CN | 102795436 | 11/2012 |
| CN | 202717236 | 2/2013 |
| WO | 2009/121092 | 10/2009 |

* cited by examiner

CONTAINER AND LID LOCKING MECHANISM THEREOF

FIELD

The present invention relates to containers, in particular to a locking mechanism to lock a container lid to a container.

BACKGROUND

A large container generally has four side plates and a base, and a lid is also provided for a large container used in transport of bulks or liquids so as to protect the cargo inside the container. There is provided an edgeguard around the lid close to the outer sides of the four side plates. When the cargo inside the container applies a large force against the four side plates, to a certain extent the edgeguard of the lid will prevent the four side plates from deforming too large. Further, when the liquids or bulks inside the container fluctuate upwardly, the lid will limit the fluctuating of a liner containing the liquids or bulks, thus preventing the liner from being damaged. Thus, the lid should be connected to the container reliably when used. In addition, the four side plates of the large container can be subsequently folded so as to reduce the space occupied when not in use, thus reduce the costs of turnover and warehousing of products. Further, when the lid is placed on the folded container, the mechanism of lid connected to the container should avoid accumulating high altitude.

One of current locking means for locking a lid to a container comprises a latch and a pit on the upper edge of the lid to accommodate the latch. A hole is provided on the sidewall of the pit through which the latch will extend into a groove on a side plate of the container. When the lid is in use, the latch will limit the upward movement of the lid, while the lateral movement of the handle on the latch is limited by the rib in the pit, so that the lid can be locked reliably. This kind of design achieves the connection of the lid to the container basically. However, when the lid is placed on the container and the latch is in extended state, the latch will be pressed directly on the side plate of the container, so that the latch may be damaged.

SUMMARY

The aim of the present invention is to provide a lid locking mechanism of a container which will not be damaged easily, and it is very convenient to open and close the lid provided with the locking mechanism.

In order to achieve the above aim, a lid locking mechanism of a container is provided. The container includes a base, side plates and a lid, wherein said locking mechanism is provided on an edge of the lid and an upper portion of the side plate; and said locking mechanism comprises a locking structure, a restoring structure and a guiding structure; wherein said locking structure is used to lock the lid to the side plates of the container, and said restoring structure and said guiding structure are used to assist the locking structure in locking the lid to the side plates.

In a preferred embodiment of the present invention, said locking mechanism includes a handle, a spring, a pit provided on the edge of the lid and a recess provided on the side plate; wherein a latch is provided on said handle, and said handle and the spring are accommodated in the pit of the lid; said latch is engaged with the pit of the side plate so as to lock the lid to the side plate; and said spring applies a restoring force to the handle.

Preferably, a hole is provided on a side wall of the pit of the lid; a sliding rail opposed to the hole is provided inside the pit; and between the sliding rail and the hole there is a rib for accommodating the spring.

Preferably, the latch is provided on one end of the handle and used to be engaged with the hole and the other end of the handle is provided with a sliding slot for engaging with the sliding rail; and the back portion of the handle is provided with an elongate slot, and a pin is provided on a side wall of the slot, wherein the elongate slot together with the rib are used to accommodate the spring.

In the above preferred embodiment, preferably, a side of the handle is provided with a notch.

In another preferred embodiment, preferably, said locking structure is a locking member; said restoring structure is a torsional spring; and said guiding structure is comprised of grooves on the lid and a mating structure on the side plate; wherein said locking member is installed in the mating structure and enters or leaves the groove so as to open or close the lid.

Preferably, the spring is fitted to said locking member and said locking member is provided with a rotation pin, a bearing pin and two position limiting pins, wherein one of the position limiting pins is provided with a projection;

said mating structure comprises pits on both ends of the upper portion of the side plate, wherein a circular hole, a special-shaped through-hole with a special arced contour, and a position limiting hole are provided at each pit; wherein when mounting the locking member to the side plate, the rotation pin is inserted into the circular hole and the two position limiting pins are inserted into the special-shaped through-hole and the position limiting hole respectively so as to hold the locking member on the mating structure; and When the lid slids on the side plates, the bearing pin will enter or leave the groove so as to locked or unlocked the lid.

Preferably, the grooves are provided on the left and right ends of an edgeguard of the lid; and a slope is provided at the outer side of each groove and a dimple is provided inside the groove, wherein an arced contour is provided on the bottom the dimple.

The present invention also provides a container, which comprising a base, side plates and a lid, wherein the container further comprises a lid locking mechanism according to the above embodiments.

According to the locking mechanism of the present invention, the locking mechanism is located on the edge of the lid or the upper portion of the side plates and has compact structure. Therefore, it helps to reduce the cumulative height of lid and the container folded and the costs of the transportation and warehousing are also reduced. In addition, the locking mechanism further includes a restoring member and a guiding member, such that when the lid is placed on the container, whether it is in a closed state or opened state, the locking mechanism will not be easily damaged, and it is very convenient to open and close the lid.

DRAWINGS

FIG. 1 is a perspective structural view of a common container;

FIG. 2*a* shows a perspective structural view of a lid provided with the lid locking mechanism according to the first embodiment of the present invention;

FIG. 2*b* shows a cross-sectional view of the lid provided with the lid locking mechanism according to the first embodiment of the present invention;

FIG. 2*c* shows an enlarged cross-sectional view of the part A of the lid in FIG. 2*b;*

FIG. 3 shows a perspective view of a locking member of the lid locking mechanism according to the first embodiment of the present invention;

FIG. 4*a* shows a front view of a mating structure of the lid locking mechanism according to the first embodiment of the present invention provided on the upper portion of a side plate;

FIG. 4*b* shows an enlarged perspective view of the mating structure in FIG. 4*a;*

Figure 7:
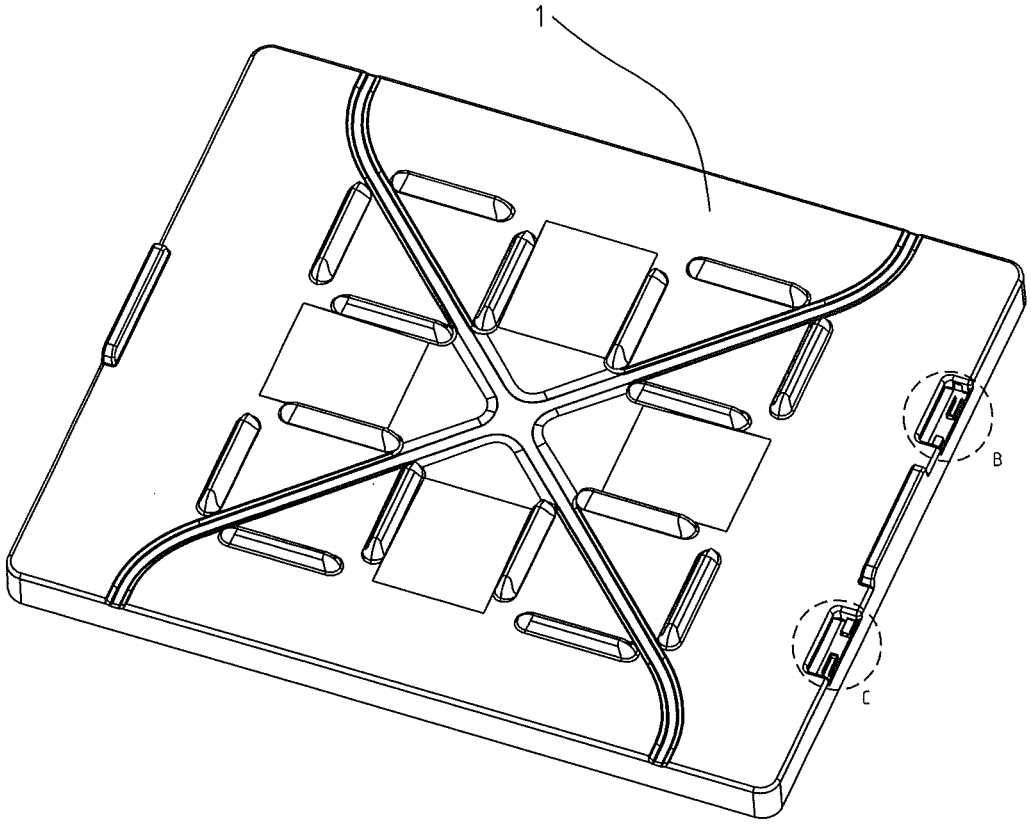
FIG. 7 shows the structure of the lid using the lid locking mechanism according to the second embodiment of the present invention.
Figure 7A:
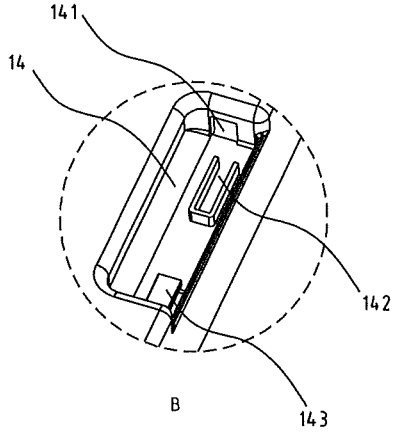
Figure 7B:
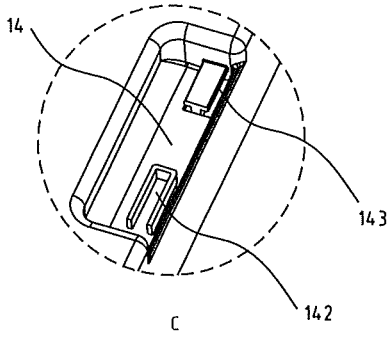
Figure 8A:
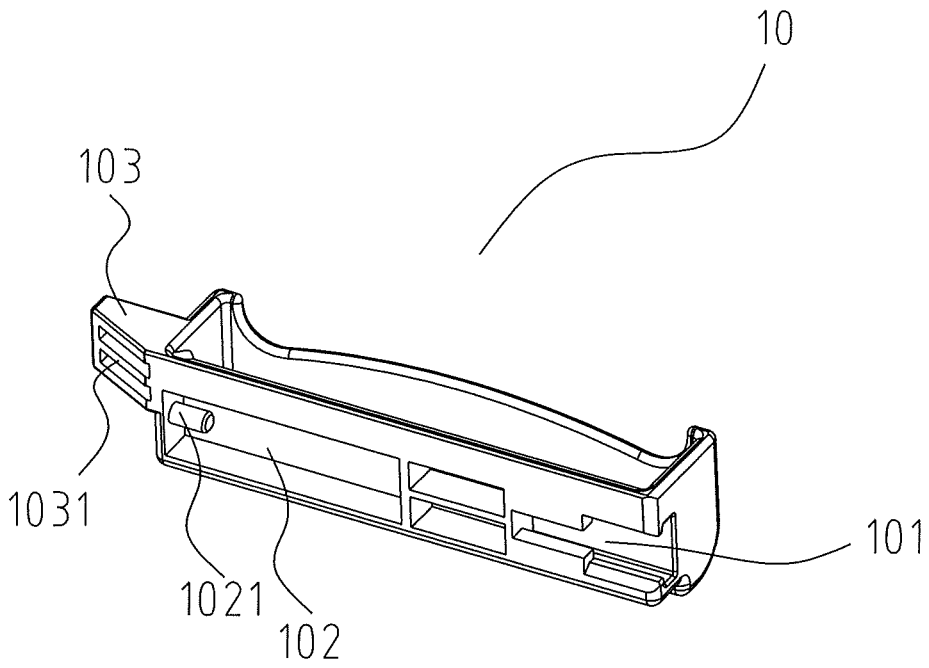
Figure 8B:
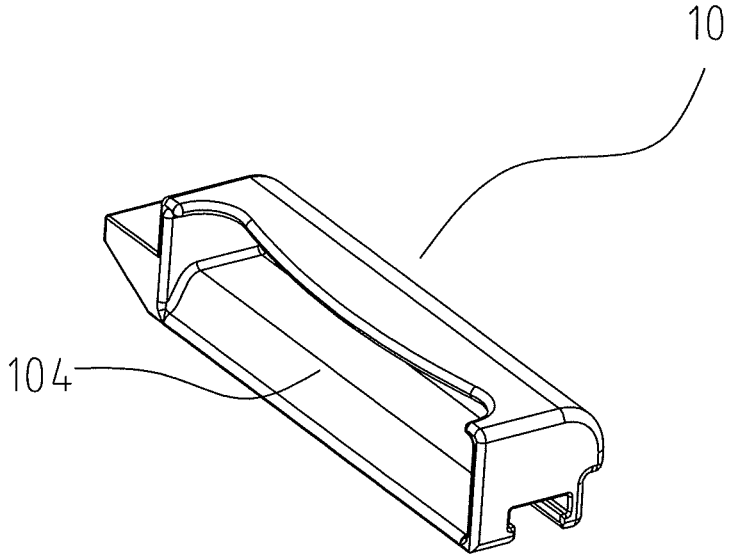
Figure 9:
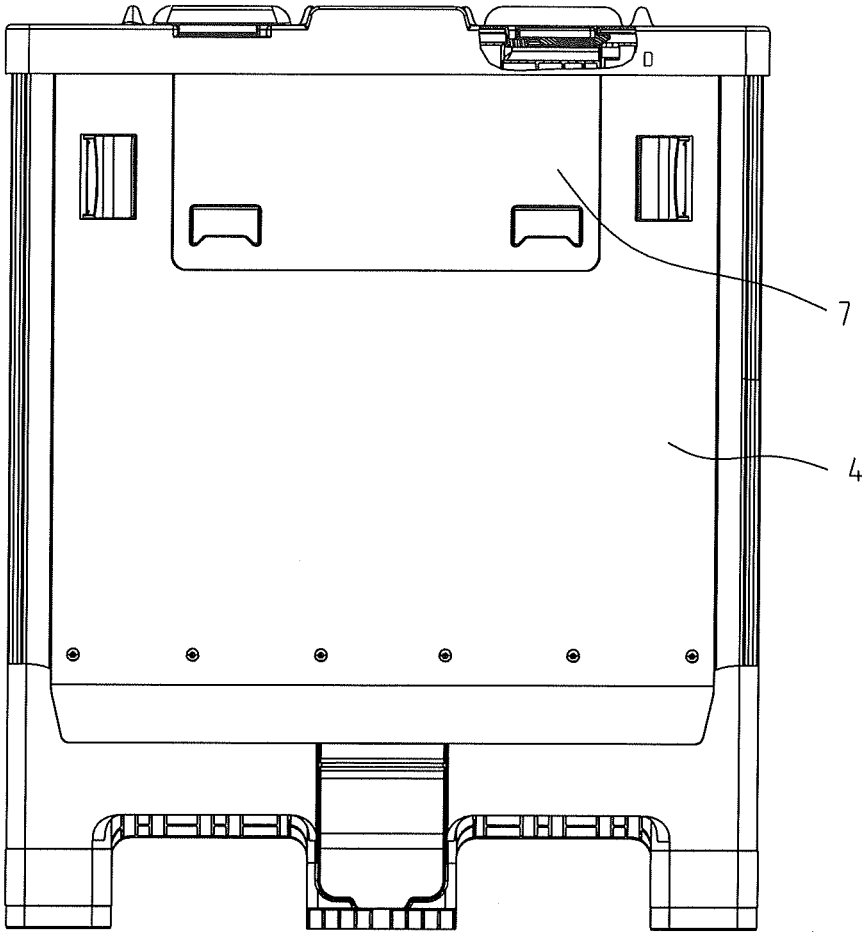
Figure 10:
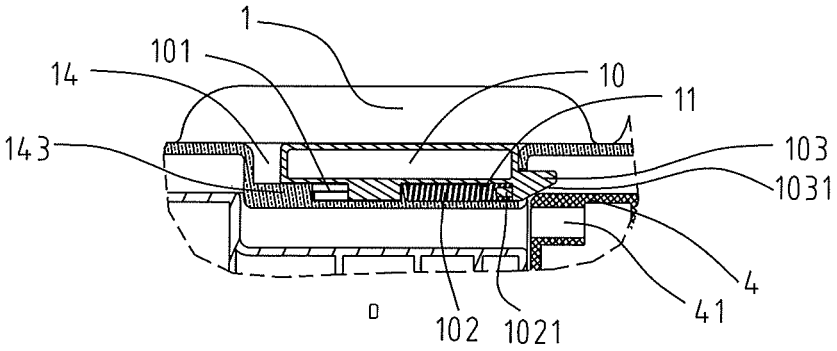
Figure 11:
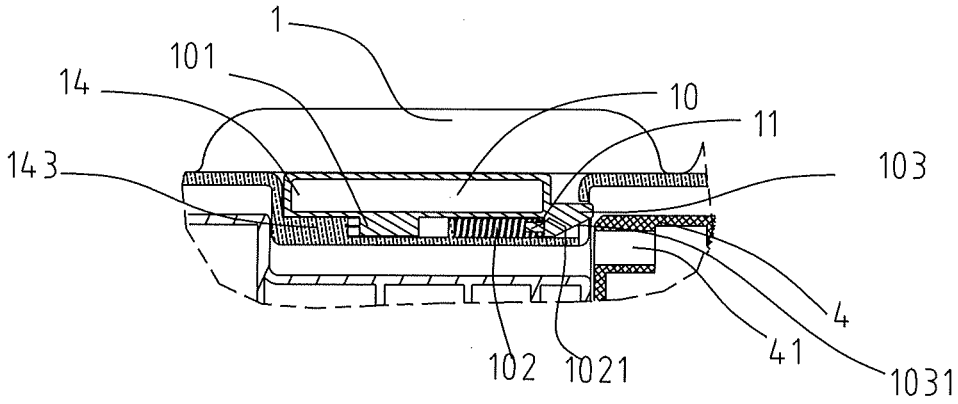
Figure 12:
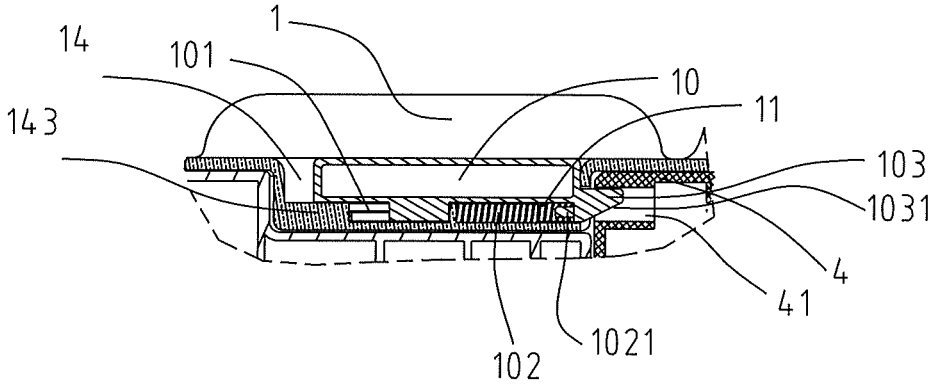

FIGS. 7*a* and 7*b* show enlarged views of parts B and C in FIG. 7 respectively;

FIGS. 8*a* and 8*b* are perspective structural view of a handle of the lid locking mechanism according the second embodiment of the present invention;

FIGS. 9 and 10 show a state when the lid is placed on the container but not fully closed, wherein FIG. 10 is an enlarged view of part D in FIG. 9;

FIG. 11 is a partial cross-sectional view of the lid locking mechanism when the lid is further pressed downward from the position in FIG. 10; and FIG. 12 shows a partial cross-sectional view of the lid locking mechanism when the lid is locked to the container.

DETAILED DESCRIPTION

Hereinafter, preferred embodiments of the present invention will be described in detail with reference to the drawings, so that the purposes, features and advantages of the present invention will be more clearly understood. It should be understood that embodiments shown in the drawings are not to limit the scope of the invention, but merely to illustrate the true spirit of the technical solution of the present invention. Herein, same or similar components are denoted by same reference numerals.

Figure 1:
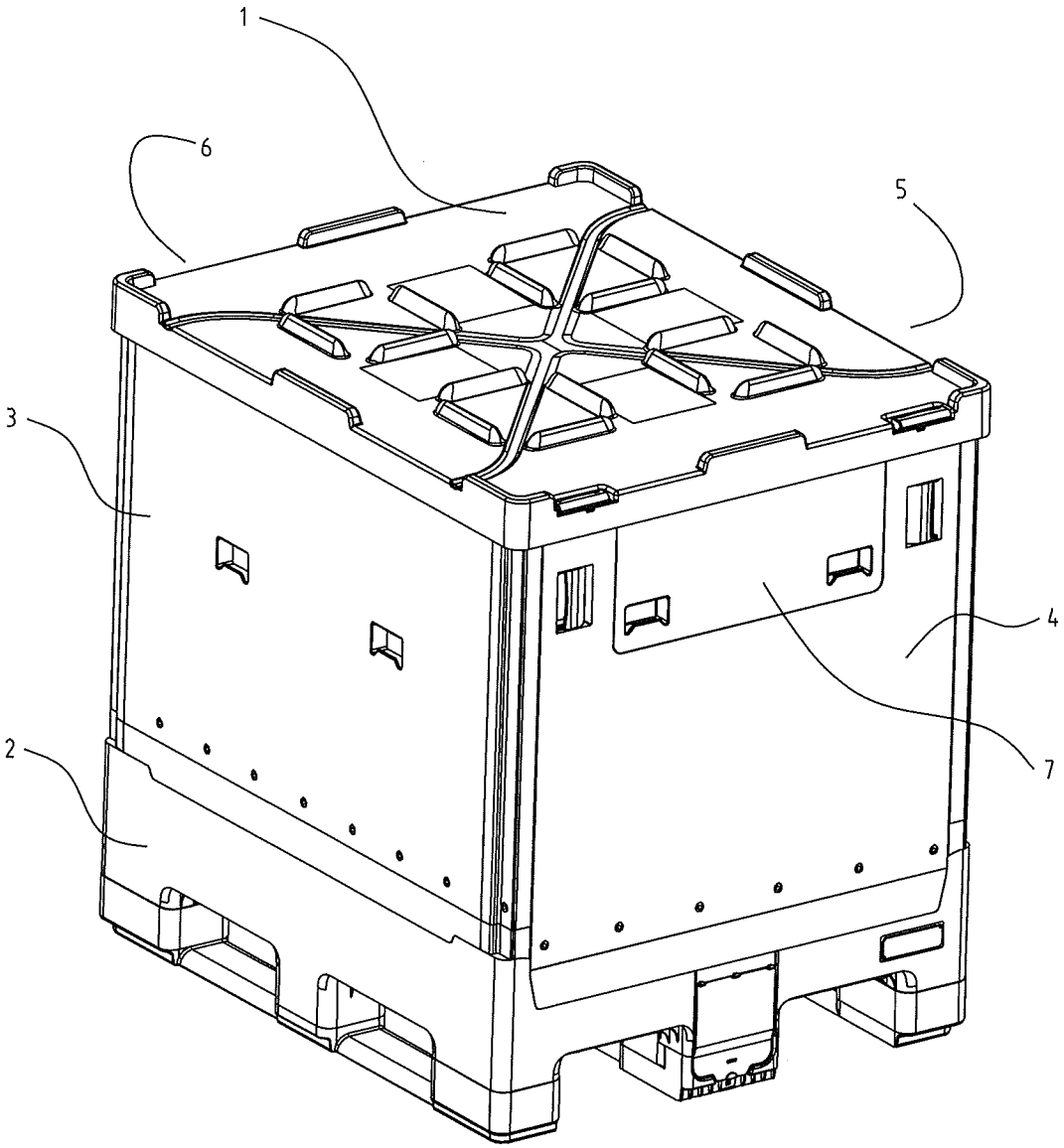

FIG. 1 shows a general structure of a large container including a lid 1, a base 2, side plates 3,4,5,6 and a small door 7. When the lid 1 is placed on the container, the edgeguard around the lid will contact (surround) the outer surfaces of side plates 3,4,5,6 so as to improve the strength of the entire container.

FIGS. 2*a*-5 show schematic structure views of the lid locking mechanism of a large container according to the first embodiment of the present invention. As shown in FIGS. 2*a*-5, the lid locking mechanism includes a groove 12 provided on the lid 1, a locking member 8 as a separate member, and mating structures provided on the side plate for engaging with the lid 1 and the locking member 8, wherein the mating structures provided on the side plate are engaged with the lid 1 and the locking member 8 so as to close or open the lid.

Figure 2A:
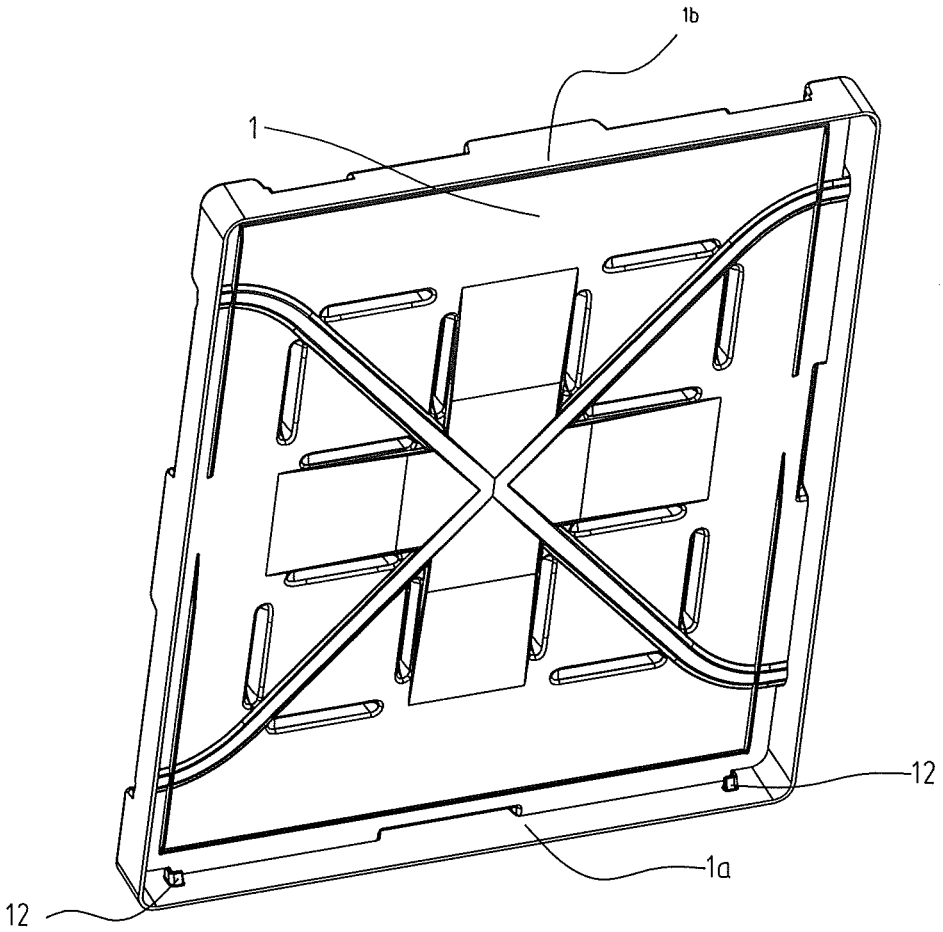
Figure 2B:
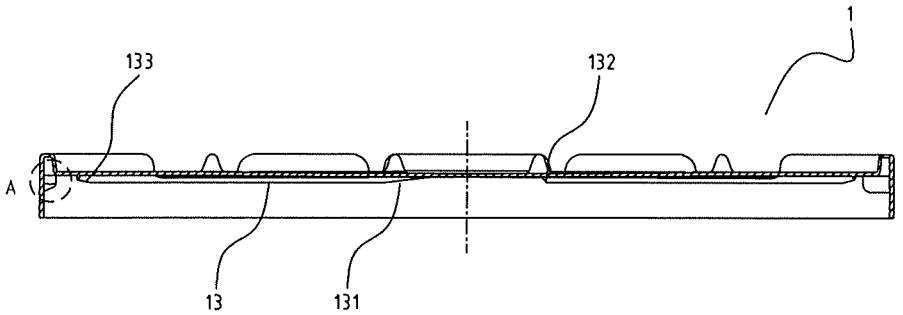
Figure 2C:
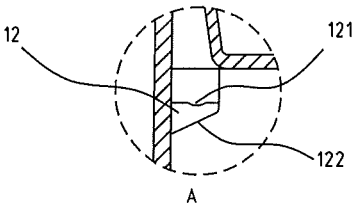

Hereinafter, the lid 1, the mating structures provided on the side plate 6, the locking member 8 and the engagement among them will be described in further detail. FIGS. 2*a*-2*c* show the structure of the lid 1 according to the embodiment. As shown in FIGS. 2*a*-2*c*, grooves are provided on the right and left end of an edgeguard 1*a* of the lid 1 on inner surface thereof respectively. A slope 122 is provided at outer side of each groove 12 so as to provide a guide for the locking member (which will be described in more detail hereinafter). A dimple 121 is provided inside the groove 12, wherein an arced contour is provided on the bottom of the dimple. Similarly, although not shown, a groove 12 is also provided on the left and right end of another edgeguard 1*b*. Alternatively, only one groove may be provided on each edgeguard of edgeguards 1*a* and 1*b*.

Figure 3:
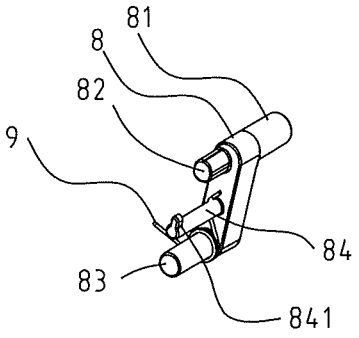

FIG. 3 is a perspective view of the locking member 8 with a torsional spring 9 thereon. The locking member 8 comprises a rotation pin 83, a bearing pin 81, a position limiting pin 82 and a position limiting pin 84, wherein the position limiting pin 84 is further provided with a projection 841. The function of the projection 841 will be described in detail in the following. The torsional spring 9 is installed on the rotation pin 83.

Figure 4A:
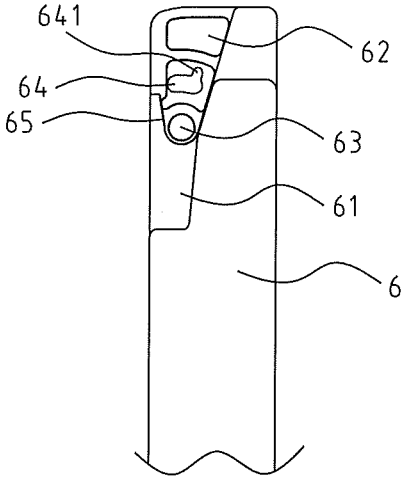
Figure 4B:
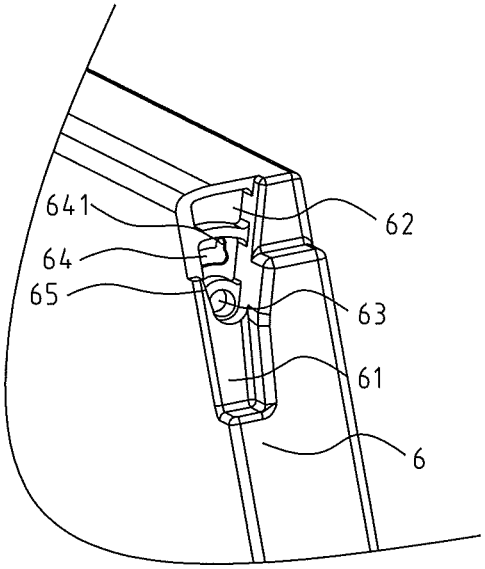

FIGS. 4*a*-4*b* are partial side views of the side plate 6, which has two pits 61 on both ends of its upper portion, wherein a circular hole 63 and a special-shaped through-hole 64 with a special arced contour 641 are provided at each pit 61. A stopping edge 65 is provided on the left of the circular hole 63. When mounting the locking member 8 to the side plate 6, the rotation pin 83 is inserted partly into the circular hole 63 firstly and the projection 841 of the position limiting pin 84 is aligned with the arced contour, then the locking member 8 can be completely mounted. After installation of the locking member 8, the position limiting pin 82 is located in the position limiting hole 62. The locking member 8 will lean against the stopping edge 65 since the torsional spring 9 will applied a counterclockwise torque to the locking member 8 continually. Now, the locking member will not able to be released due to the deviation of the arced contour 641 from the projection 841. The locking member can be released only in the case that the projection 841 of the position limiting 84 is aligned with the arced contour 641. Further, although not shown, corresponding structures are also provided at the side plate 4 opposed to the side plate 6.

Figure 5:
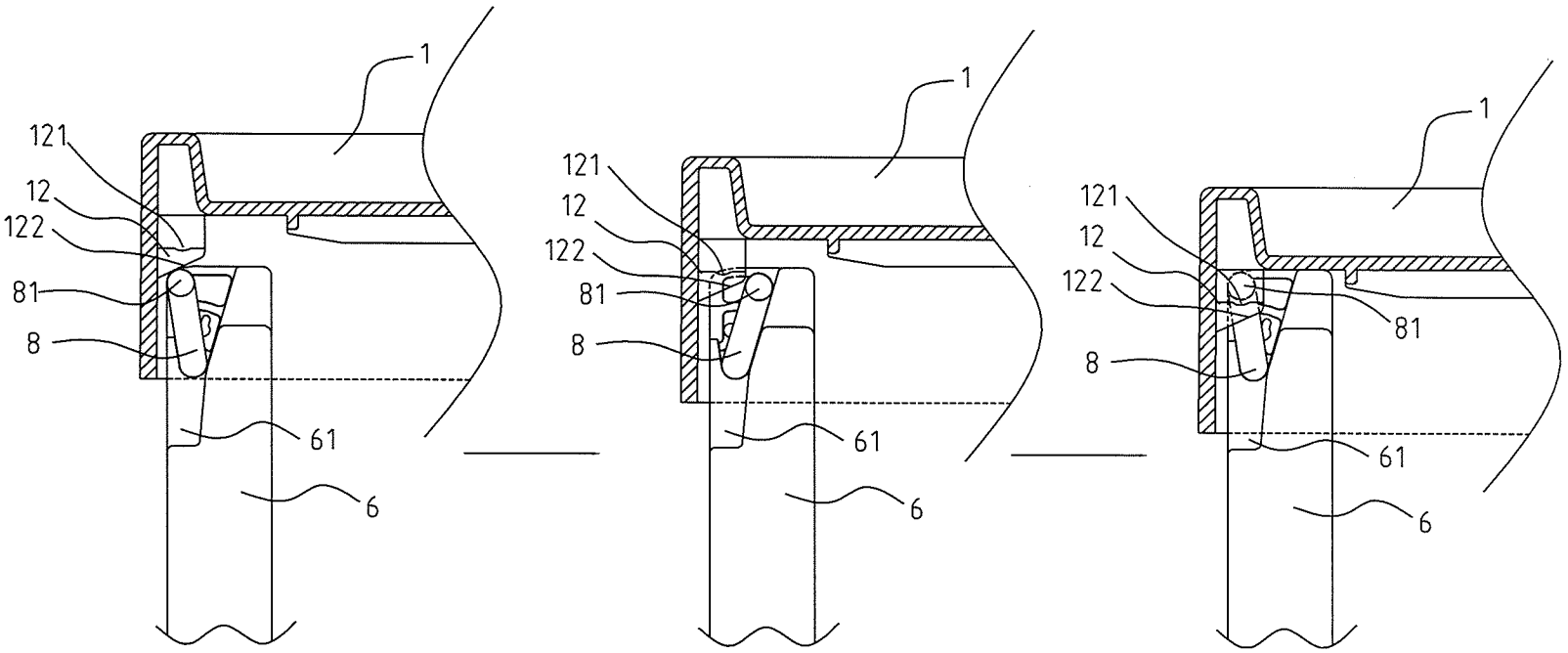
FIG. 5 shows the process of the locking member entering a groove on the lid when the lid is placed on the container from directly above the container, according to the first embodiment of the present invention.

FIG. 5 shows the process of the locking member 8 entering the groove 12 when the lid 1 is placed on the container from directly above the container. The slope 122 will contact with the bearing pin 81 of the locking member 8 firstly, and the locking member 8 will be forced to rotate an angle clockwise around its rotation pin 83 due to the pressure applied by the slope 122, which makes the bearing pin 81 to leave the location under the groove 12. When the lid 1 is in place, the bearing pin 81 face exactly to the dimple 121 of the groove 12. Then, the locking member 8 will rotate counterclockwise around the rotation pin 83 due to the restore of the torsional spring 9, so that the bearing pin 81 enters into the dimple 121, thereby limiting the upward movement of the lid 1.

During the process of opening the lid 1, when the lid 1 is opened by a distance from its left side, i.e. from the side plate 4, the lid 1 rotates by a certain angle around a position where the lid 1 contacts with the left and upper portion of the side plate 6. Then, the bearing pin 81 of the lid locking member 8 will be released from the groove 12 when continuing to push the lid 1 forward so as to open the lid 1.

Figure 6:
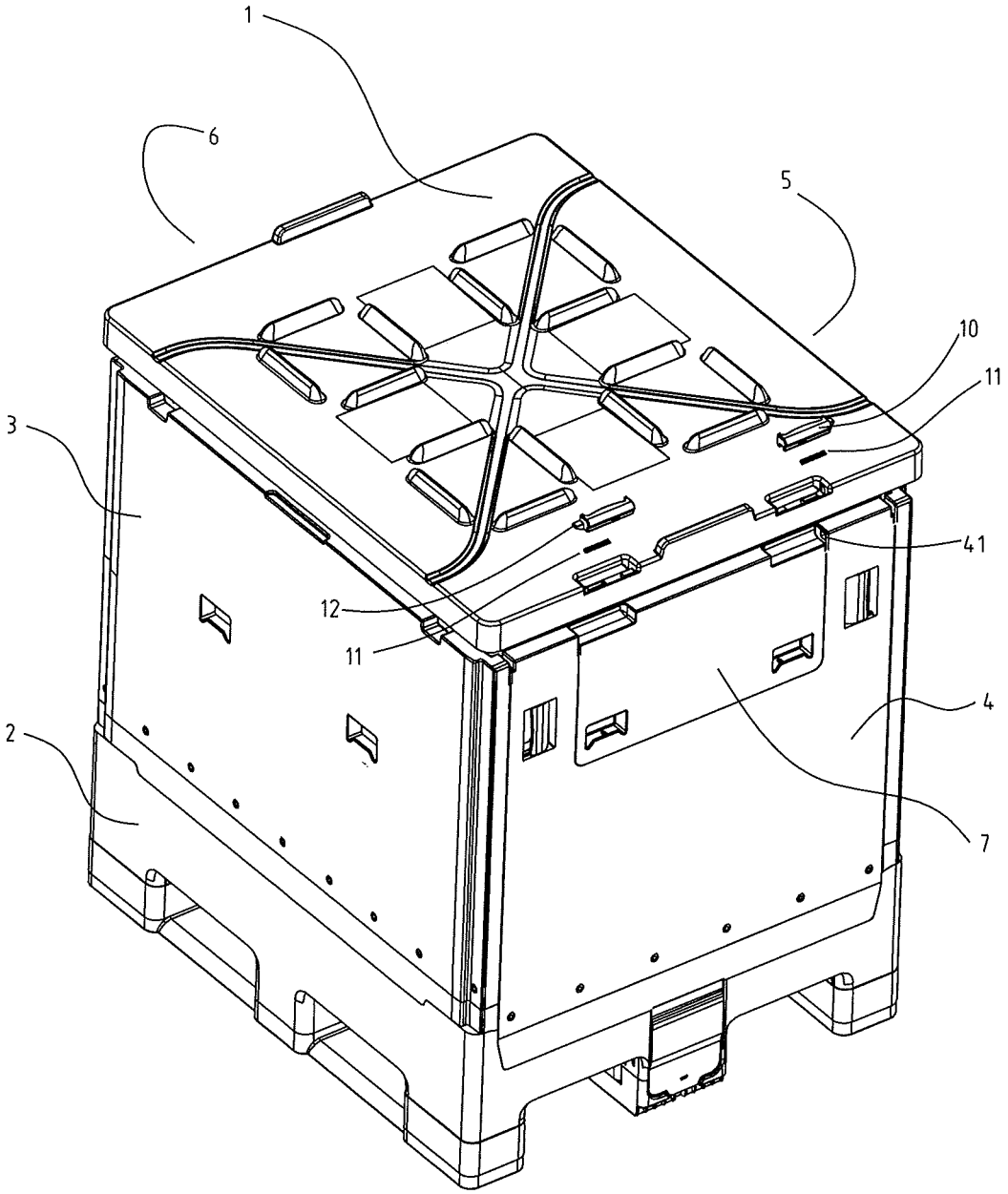
FIG. 6 shows a perspective structural view of the container provided with a lid locking mechanism according to the second embodiment of the present invention.

FIGS. 6-12 show perspective structural views of the lid locking mechanism provided at a large container according to the second embodiment of the present invention. As shown in FIG. 6, the lid locking mechanism comprises a pit 14 provided at edge of the lid, a left handle 12, a right handle 10 and a spring 11. As shown more clearly in FIGS. 7-7*b*, a square hole 141 (or polygon hole 141) is provided on one side wall of the pit 14, and a sliding rail 143 opposed to the hole 141 is provided inside the pit 14, wherein the cross section of sliding rail 143 is I-shaped, but also may be other types, such as T-shaped. Between the sliding rail 143 and the square hole 141 there is a u-shaped rib 142 for accommodating the spring 11.

FIGS. 8*a*-8*b* show the right handle 10 of the lid locking mechanism. The left handle 12 will not be elaborated here since the structure and function of the left handle 12 are same as the right handle. As shown in FIG. 8*a*, one end of the right handle 10 is provided with a latch 103 with a slope 1031 and a sliding slot 101 is provided on the other end of the right handle 10. The back portion of the handle 10 is provided with an elongate slot 102 with a small pin 1021 on its side wall. As shown more clearly in FIG. 8*b*, a notch 104 for facilitating gripping is further provided on the side portion of the handle 10.

FIGS. 9 and 10 show the state that the lid 1 is placed on the container but not fully closed, wherein FIG. 10 is an enlarged view of part D in FIG. 9. As shown in FIG. 10, when the handle 10 is placed in the pit 14 of the lid 1, the sliding rail 143 is engaged with the sliding slot 101 and the latch 103 passes through the square hole 141. The spring 11 is placed within a cavity formed by the slot 102 of the right handle 10 and the rib 142 of the lid, wherein the pin 1021 assists in preventing the spring 11 from releasing from the slot 102 of the right handle 10 easily. Thus, the latch 103 of the handle 10 will tend to be always in a running out state due to the restore of the spring.

As shown in FIGS. 11-12, when the lid 1 is further pressed down, a pressure is applied to the lid 1 and the right handle 10 will move toward the left due to the guiding of the slope 1031 of the latch 103, which causes the latch 103 to run across a side part of the side plate 4. When a pressure is further applied, the lid 1 will be fitted to the container, and the latch 103 may enter into a recess 41 on the side plate 4 under the action of the spring 11 so as to lock the lid 1 to the side plate.

When opening the lid 1, the handle 10 is moved along the sliding rails so that the latch 103 is pushed out of the recess 41 of the side plate and then the lid 1 is lifted up so as to open the lid.

It should be noted that, the lid and the side plates can be provided with an appropriate number of the lid locking mechanisms if necessary.

According to the embodiments described above, the locking mechanism is located on the edge of the lid or the upper portion of the side plates and has compact structure. Therefore, it helps to reduce the cumulative height of lid and the container folded and the costs of the transportation and warehousing are also reduced. In addition, the locking mechanism further includes a restoring member and a guiding member, such that when the lid is placed on the container, whether it is in a closed state or opened state, the locking mechanism will not be easily damaged, and it is very convenient to open and close the lid.

Preferred embodiments of the present invention has been described in detail above, while it is to be understood that, after reading the above teachings of the present invention, those skilled in the art may make various modifications or amendments to the present invention. These equivalent forms still fall into the scope limited by appended claims of the present application.

What is claimed is:

1. A lid locking mechanism of a container, which has a base, side plates and a lid, wherein said locking mechanism is provided on an edge of the lid and an upper portion of one of the side plates, said locking mechanism comprising:

a locking structure, a restoring structure, and a guiding structure, wherein said locking structure is used to lock the lid to the side plates of the container, said restoring structure and said guiding structure are used to assist the locking structure in locking the lid to the side plates, and said locking mechanism includes a handle, a spring, a pit provided on the edge of the lid and a recess provided on the one of the side plates, and wherein a latch is provided on said handle, said handle and the spring are accommodated in the pit of the lid, said latch is engaged with the recess of the one of the side plates so as to lock the lid to the one of the side plates, said spring applies a restoring force to the handle, a hole is provided on a side wall of the pit of the lid, a sliding rail opposed to the hole is provided inside the pit, and between the sliding rail and the hole there is a rib for accommodating the spring.

2. The locking mechanism as claimed in claim 1, wherein the latch is provided on one end of the handle and used to be engaged with the hole and the other end of the handle is provided with a sliding slot for engaging with the sliding rail; and the back portion of the handle is provided with an elongate slot, and a pin is provided on a side wall of the slot, wherein the elongate slot together with the rib are used to accommodate the spring.

3. The locking mechanism as claimed in claim 2, wherein a side of the handle is provided with a notch.

4. A lid locking mechanism of a container, which has a base, side plates and a lid, wherein said locking mechanism is provided on an edge of the lid and an upper portion of one of the side plates, said locking mechanism comprising:

a locking structure, a restoring structure, and a guiding structure, wherein said locking structure is used to lock the lid to the side plates of the container, and said restoring structure and said guiding structure are used to assist the locking structure in locking the lid to the side plates, wherein said locking structure is a locking member, said restoring structure is a torsional spring, and said guiding structure is comprised of grooves on the lid and a mating structure on the one of the side plates, wherein said locking member is installed in the mating structure and enters or leaves the groove so as to open or close the lid, the spring is fitted to said locking member and said locking member is provided with a rotation pin, a bearing pin and two position limiting pins, wherein one of the position limiting pins is provided with a projection, said mating structure comprises pits on both ends of the upper portion of the one of the side plates, wherein a circular hole, a special-shaped through-hole with a special arced contour, and a position limiting hole are provided at each pit, and wherein the rotation pin is inserted into the circular hole and the two position limiting pins are inserted into the special-shaped through-hole and the position limiting hole respectively so as to hold the locking member on the mating structure when mounting the locking member to the one of the side plates, and the bearing pin will enter or leave the groove so as to lock or unlock the lid when the lid slides on the side plates.

5. The locking mechanism as claimed in claim 4, wherein the grooves are provided on the left and right ends of an edge guard of the lid; and a slope is provided at the outer side of each groove and a dimple is provided inside the groove, wherein an arced contour is provided on the bottom the dimple.

6. A container, comprising a base, side plates and a lid, wherein the container further comprises a lid locking mechanism as claimed in claim 1.

* * * * *